US008899428B2

(12) United States Patent
Peñafiel Monteserin

(10) Patent No.: US 8,899,428 B2
(45) Date of Patent: Dec. 2, 2014

(54) WINE BOTTLE WITH THE WINE IN PERMANENT CONTACT WITH THE CORK

(75) Inventor: Gregorio Peñafiel Monteserin, Briones (ES)

(73) Assignee: El Cantillo, S.A., Briones (La Rioja) (ES)

( * ) Notice: Subject to any disclaimer, the term of this patent is extended or adjusted under 35 U.S.C. 154(b) by 0 days.

(21) Appl. No.: 13/201,925

(22) PCT Filed: Feb. 17, 2010

(86) PCT No.: PCT/ES2010/000068

§ 371 (c)(1),
(2), (4) Date: Sep. 22, 2011

(87) PCT Pub. No.: WO2010/094822

PCT Pub. Date: Aug. 26, 2010

(65) Prior Publication Data

US 2012/0018399 A1 Jan. 26, 2012

(30) Foreign Application Priority Data

Feb. 18, 2009 (ES) ..... 200900544
Dec. 30, 2009 (ES) ..... 200902420

(51) Int. Cl.

| | |
|---|---|
| ***B65D 23/06*** | (2006.01) |
| ***B65D 39/00*** | (2006.01) |
| ***B65D 21/02*** | (2006.01) |
| ***B65D 1/02*** | (2006.01) |

(52) U.S. Cl.

CPC ..... *B65D 39/0011* (2013.01); *B65D 21/0231* (2013.01); *B65D 1/023* (2013.01); *Y10S 220/19* (2013.01)

USPC ..... 215/41; 215/43; 220/801; 220/DIG. 19

(58) Field of Classification Search

CPC ..... B65D 39/0005; B65D 39/0011; B65D 39/0058; B65D 39/04; B65D 39/0023; B65D 21/0231; B65D 1/023; B65D 23/06; B65D 47/40; B65D 39/00

USPC ..... 215/296, 320, 355, 50, 54, 40, 41, 43, 215/299; 220/787, 789, 800, 801, 307, 220/DIG. 19

See application file for complete search history.

(56) References Cited

U.S. PATENT DOCUMENTS 3,143,255 A * 8/1964 Leeds ..... 222/479
3,198,367 A * 8/1965 Stickney ..... 215/40

(Continued)

FOREIGN PATENT DOCUMENTS

CH 380564 A 7/1964
EP 0905033 A1 3/1999

(Continued)

*Primary Examiner* — Robert J Hicks
*Assistant Examiner* — Kareen Rush
(74) *Attorney, Agent, or Firm* — Browdy and Neimark, PLLC

(57) ABSTRACT

A bottle including a main body and a bottle neck which accommodates a cap, where the bottle neck includes interior walls in contact with the cap and exterior walls not in contact with the cap. At least part of the exterior walls is located inside the bottle. When the bottle is filled with wine and the bottle is in vertical position, the fill level of wine reaches a point of the exterior walls of the bottle neck that is inside the bottle, causing the wine to be in permanent contact with the cap. Therefore, the construction allows for the possibility of not having to store the bottle in horizontal position to guarantee the correct conservation of the wine and the cork.

11 Claims, 3 Drawing Sheets

(56) References Cited

U.S. PATENT DOCUMENTS

| | | | | |
|---|---|---|---|---|
| 3,556,338 | A * | 1/1971 | Wilkinson et al. | 220/792 |
| 4,140,235 | A * | 2/1979 | Rausing et al. | 215/305 |
| 4,165,350 | A * | 8/1979 | Greenberg | 156/89.11 |
| 4,362,250 | A * | 12/1982 | Cottingham | 215/247 |
| 4,838,464 | A * | 6/1989 | Briggs | 222/478 |
| 4,997,124 | A * | 3/1991 | Kitabatake et al. | 228/184 |
| 6,227,392 | B1 | 5/2001 | Balzeau | |
| 7,721,922 | B2 * | 5/2010 | Balzeau | 222/540 |
| 7,748,550 | B2 * | 7/2010 | Cho | 215/228 |
| 7,757,889 | B1 * | 7/2010 | Zipris et al. | 220/789 |
| 8,376,161 | B2 * | 2/2013 | Golden | 215/228 |
| 2005/0040130 | A1 | 2/2005 | Bivens | |
| 2008/0277373 | A1 * | 11/2008 | Gibis et al. | 215/364 |

FOREIGN PATENT DOCUMENTS

| | | | |
|---|---|---|---|
| EP | 1394052 | A1 | 3/2004 |
| FR | 2769597 | A1 | 4/1999 |
| WO | WO 03066455 | A2 | 8/2003 |
| WO | WO 2007058500 | A1 | 5/2007 |

* cited by examiner

WINE BOTTLE WITH THE WINE IN PERMANENT CONTACT WITH THE CORK

FIELD

The invention relates to a wine bottle, with a design that allows permanent contact between the wine contained inside the bottle and the cork, regardless of the bottle's position, including the vertical position.

STATE OF THE ART

In the wine elaboration process, it is well known that, at a certain time of such process, wine is bottled and stored for the period of time required to obtain a certain type of wine, after which the wine is marketed in such bottles, duly labelled. The body of such bottles is essentially a cylinder, with a narrower bottle neck at the top, where the cork is placed. Basically, the cork prevents the wine from spilling out of the bottle and air from going into the bottle.

Inside the wine bottles, in addition to the wine, there is a small amount of air. In other words, bottles have an air chamber. Among other functions, said air chamber allows the wine to change volume as a result of changes in temperature, without it pushing the cork outwardly. Also, because the air chamber is in contact with the wine, it allows for the micro-oxygenation of the wine, said micro-oxygenation being an important phenomenon in the wine aging process.

When conventional bottles are placed in vertical position, the air chamber is located between the wine and the cork. Therefore, there is no direct contact between the wine and the cork, which remain separated by air. This gives rise to different problems: on the one hand, the cork dehydrates and reduces the pressure it makes against the bottle's neck, allowing for air to enter into the bottle, and wine to exit the same; additionally, if the wine cools down, and consequently contracts, a depression is caused between the air inside the bottle and the air outside the same, and therefore, air enters the bottle. It must be taken into account that, in both cases, the entry of air is undesired, given that air can carry mold, contaminating agents or other substances which are detrimental for the quality and conservation of the wine.

To avoid this, when wine is stored in cellars, it is necessary to place the bottles in horizontal position. This way, permanent contact with the cork is ensured, keeping the cork hydrated and minimizing the amount of air that flows into the bottles.

To this effect, there have been many studies and communications stressing the importance of the permanent contact between the cork and the wine. For example the Oenology Faculty of Bordeaux, Université Victor Segalen Bordeaux, in the research titled "Oxygen ingress into wine bottles through different closures", literally states "this study provides results regarding the kinetics of oxygen ingress through different cylindrical closures and screw-caps in wines stored horizontally" and "contact with the liquid is an important factor in the transmission of oxygen through the cork caps".

On another note, once the wine ageing process finishes, bottles are usually packaged in boxes of six, twelve or another number of units, for transport or storage. In such boxes, the bottles are set in the vertical position, which allows, thanks to the resistance provided by the essentially cylindrical shape of the bottles, vertical piling of several boxes without the bottles stored in the same being broken. In other words, it is common practice that, after having the wine age in bottles placed horizontally, making sure that the wine is in contact with the cork, these bottles are subsequently stored vertically in boxes, piling one box on top of another. With the conventional design of bottles, it would not be possible to place the bottles in horizontal position inside the boxes and later pile the same number of boxes, since the bottles would not resist the weight and would break.

The purpose of this invention is to provide a bottle filled with wine that, besides having of course an internal air chamber, allows for permanent contact between the wine and the cork when the bottle is placed vertically. A bottle of such a kind could be stored vertically, without damaging the cork or the wine, and would provide significant advantages as a result of reducing the time and cost of manipulating the bottles to vary their position from vertical to horizontal and vice versa.

BRIEF DESCRIPTION OF THE INVENTION

The subject matter of the invention is a filled wine bottle that comprises a main body, and which comprises a bottle neck where a cap is placed, where the bottle neck comprises interior walls in contact with the cap, and exterior walls which are not in contact with the cap, with the particularity that at least part of the exterior walls of the bottle neck (i.e., all or some of the exterior walls, each one of them completely or partially) are located inside the bottle. This way, when the wine bottle is filled almost in its entirety and up to a certain level (above which there must be an air chamber to allow the expansion and retraction of the wine as a result of temperature changes), the bottle being in vertical position, the level of wine reaches a point of the exterior walls of the bottle neck which is inside the bottle. In consequence, the air chamber is not in contact with the cap, but rather the cap is directly in contact with the wine.

The cap and the wine are permanently in contact in the bottle according to the invention, not only when the bottle is placed vertically, but also in any other position.

This way, the invention provides a bottle that guarantees permanent contact between the cork and the wine, with no need to place the bottle horizontally, i.e., when it is placed in any position, including a vertical position. Therefore, a series of important and interesting advantages are achieved with the invention. On the one hand, all manipulation in wine cellars for the purpose of placing the bottles in a horizontal position, so that the cork is in contact with the wine, are eliminated, reducing the time and cost of the manipulation and preparation process of the bottles of wine. Additionally, during the storage and until final consumption, no attention is required to keep the bottles in horizontal position. Or, alternatively, the risk of deterioration of the wine is eliminated when the bottles are stored in vertical position, generally inside boxes, with the possibility of piling a great number of boxes, once the ageing process has concluded. Additionally, the bottles contemplated in the invention, given the amount of wine that is above the cork base, guarantee contact between the wine and the cork for at least 50 years, i.e., they guarantee a long conservation of the cork and, therefore, of the wine stored in the bottle. They also have the advantage that, when the wine is served, the dregs in the bottle are retained in the area of the air chamber, and do not fall into the glass or other recipient into which the wine is served.

BRIEF DESCRIPTION OF THE FIGURES

The details of the invention can be seen in the figures attached, which are not intended to limit the scope of the invention.

DETAILED DESCRIPTION OF THE INVENTION

Figure 1:
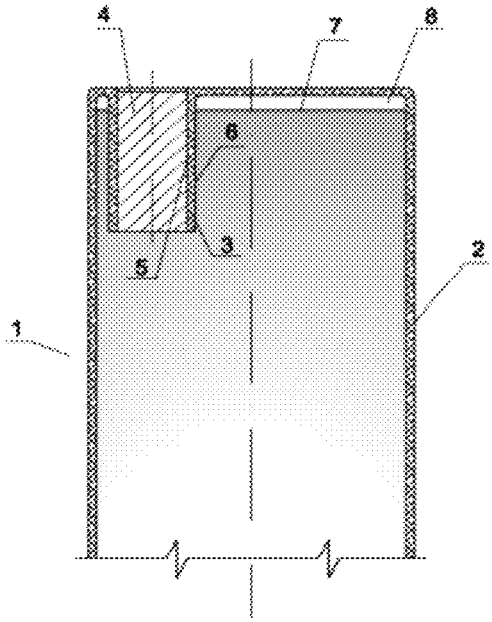
FIGS. 1 and 2 respectively show a sectional longitudinal elevation and top view of a first embodiment of the invention.
Figure 2:
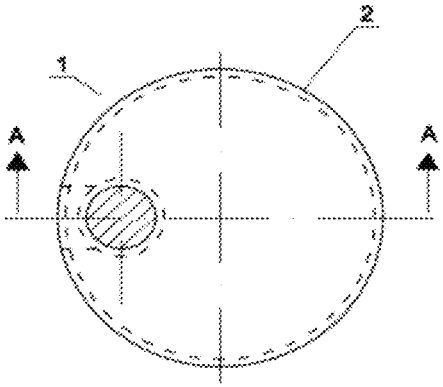

FIGS. 1 and 2 respectively show a sectional longitudinal elevation and a top view of a first embodiment of the invention. The section of FIG. 1 is made pursuant to the A-A section plane of FIG. 2. The figures show a bottle (1) with a main body (2) and a bottle neck (3). The bottle neck (3) serves to accommodate a cap (4), and comprises interior walls (5) in contact with the cap (4) and exterior walls (6) not in contact with the cap (4). In FIG. 1, the bottle (1) is shown practically full of wine, up to a fill level (7). Above such fill level (7) there is an air chamber (8), which is necessary to allow the expansion or compression of the wine in the case of temperature changes. According to the invention, and as it can be observed, all of the exterior walls (6) of the bottle neck (3) are located inside the bottle (1), so that when the bottle (1) is filled with wine practically in its entirety and with the bottle (1) in vertical position, the fill level (7) of the wine reaches a point (generally an intermediate point) of the exterior walls (6) of the bottle neck (3) which are inside the bottle (1), causing the wine to be in contact with the cap (4) and the air chamber (8) to remain above the lower part of the cap (4).

In addition to the general advantages of the invention, the present embodiment provides the additional advantage of saving glass and other materials, for a same amount of wine stored, compared to a conventional bottle of wine. More specifically, it is estimated that 5% less glass, 18% less packaging material for the bottles, and 18% in storage volume are required.

Figure 3:
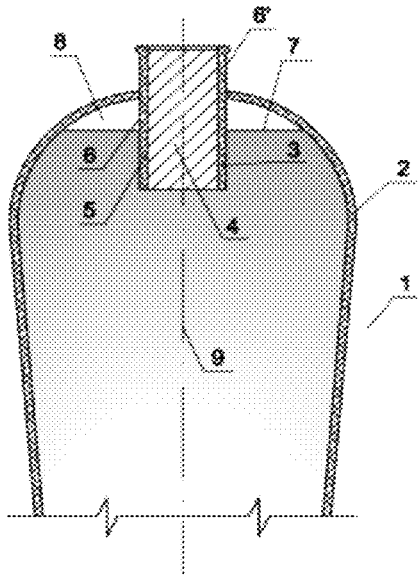
FIGS. 3 and 4 respectively show a sectional longitudinal elevation and top view of a second embodiment of the invention.
Figure 4:
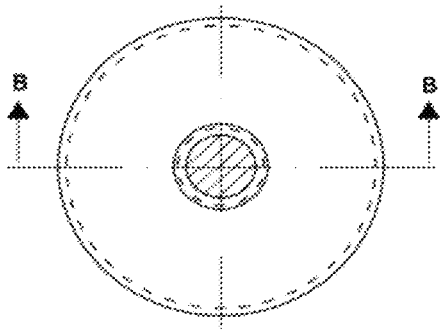

FIGS. 3 and 4 respectively show a sectional longitudinal elevation and top view of a second embodiment of the invention. The section of FIG. 3 is made pursuant to the B-B section plane of FIG. 4. In this case, the bottle neck (3) that accommodates the cap (4) is only partially inside the bottle (1). In other words, only a part of the exterior walls (6) of the bottle neck (3) is located inside the bottle (1)—as it can be seen, the part (6') remains outside—. Again, when the bottle (1) is filled with wine practically in its entirety, and with the bottle (1) in vertical position, the fill level (7) of wine reaches a point of the part of exterior walls (6) of the bottle neck (3) which is inside the bottle (1), causing the wine to be in contact with the cap (4).

Figure 5:
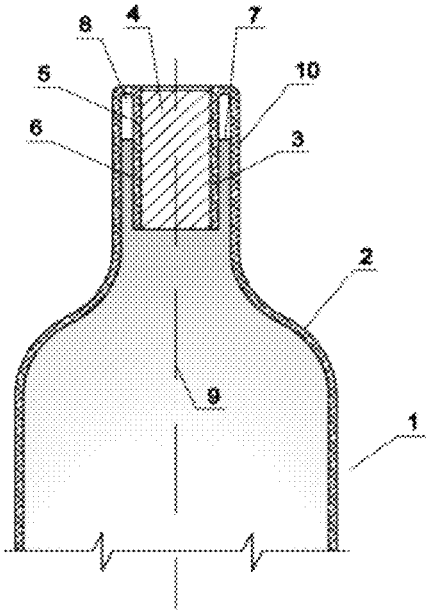
FIGS. 5 and 6 respectively show a sectional longitudinal elevation and a top view of a third embodiment of the invention.
Figure 6:
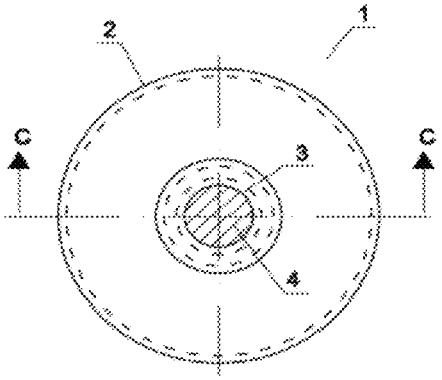

FIGS. 5 and 6 respectively show a sectional longitudinal elevation and top view of a third embodiment of the invention. The section of FIG. 5 is made pursuant to the C-C section plane of FIG. 6. In this case, the bottle neck (3) is located fully inside the bottle (1) and completely surrounded by an exterior bottle neck (10), and the air chamber (8) and fill level (7) are located between both bottle necks (3, 10). This embodiment, seen from the outside, resembles a conventional bottle, but solving the problem of the lack of contact of the wine with the cap (4) which exists in conventional bottles.

Figure 7:
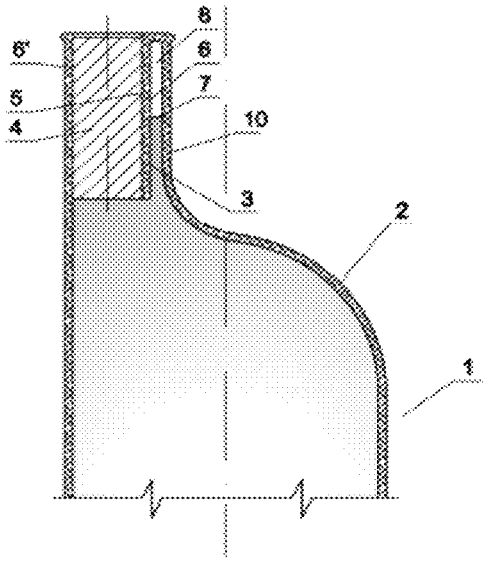
FIGS. 7 and 8 respectively show a sectional longitudinal elevation and a top view of a fourth embodiment of the invention.
Figure 8:
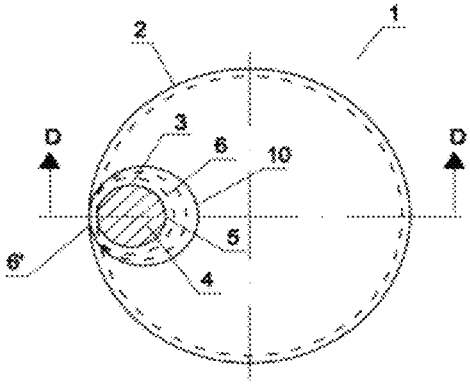

FIGS. 7 and 8 respectively show a sectional longitudinal elevation and top view of a fourth embodiment of the invention. The FIG. 7 section is made pursuant to the D-D section plane of FIG. 8. In this case, the bottle neck (3) is partially surrounded by an exterior bottle neck (10)—leaving some exterior walls (6') of the exterior walls (6) of the bottle neck (3) uncovered by the exterior bottle neck (10)—. The air chamber (8) and the fill level (7) are located between the exterior bottle neck (10) and the exterior walls (6) of the bottle neck (3) which are covered by the exterior bottle neck (10). Therefore, the air chamber (8) is not in contact with the cap (4); instead, the lower part of the cap (4) is submerged in wine.

Figure 9:
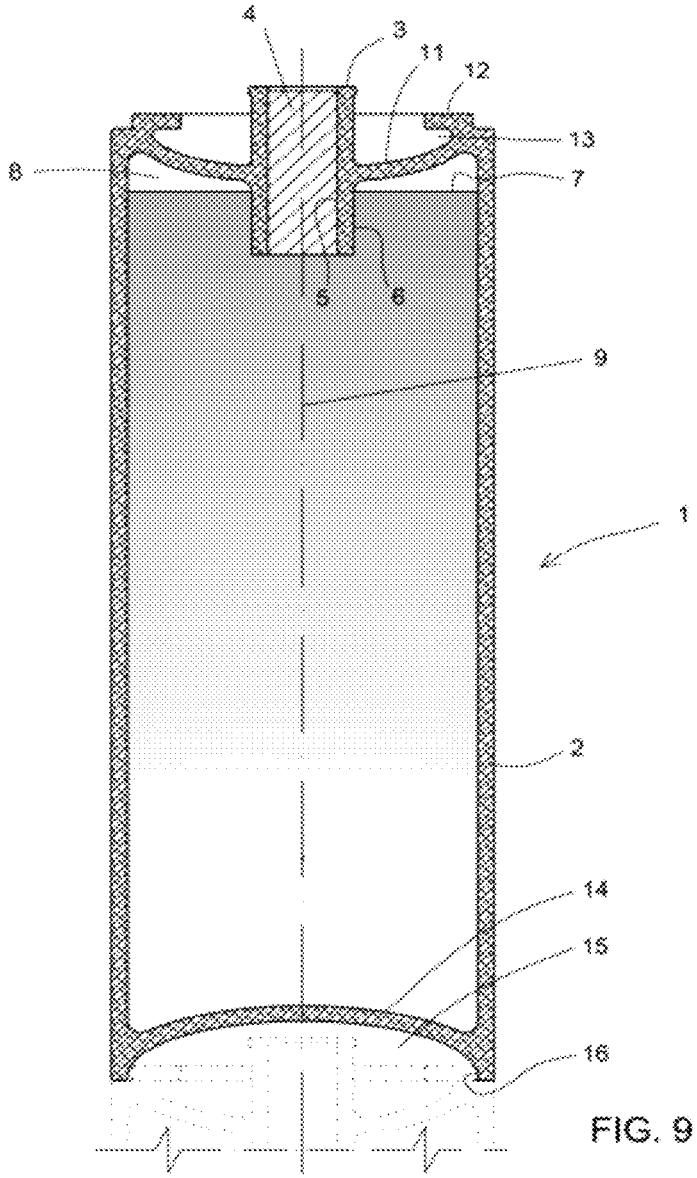
FIGS. 9 and 10 respectively show a sectional longitudinal elevation and a top view of a fifth embodiment of the invention.
Figure 10:
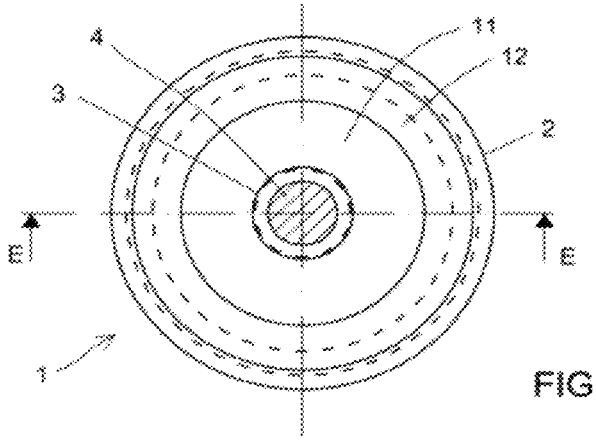

FIGS. 9 and 10 respectively show a sectional longitudinal elevation and a top view of a fifth embodiment of the invention. The section of FIG. 9 section is made pursuant to the E-E section plane of FIG. 10. In this embodiment, the bottle neck (3) is located on a superior concave face (11) of the main body (2). Additionally, on said superior concave face (11) there is a cover (12) that partially covers the superior concave face (11). Between the cover (12) and the superior concave face (11) a wine drop accumulation area (13) is formed. This embodiment allows that, when the bottle (1) is set in a vertical position after serving wine into a glass, the drops that may appear on the top part of the bottle neck (3) roll down the outside of bottle neck (3) until they reach the superior concave face (11); then, the next time wine is served, drops gathered in the superior concave face (11) roll and accumulate in the accumulation area (13), and therefore remain confined in the superior concave face (11).

Preferably, cover (12) is continuous along the complete perimeter of the superior concave face (11), as shown in the figures. This allows not having to orientate the bottle (1) in any specific direction when serving wine so that the drops stay accumulated and do not fall.

Additionally, as shown in FIG. 9, where bottle (1) is shown piled over a second bottle, the main body (2) comprises an inferior concave face (14) forming a housing area (15). Said housing area (15) is in charge of housing the bottle neck (1) and the cover (12) of the second bottle. Thus, the bottle (1) according to the invention is capable of being piled, in a simple and stable manner, guaranteeing the correct preservation of the cap (4) and the wine.

Preferably, to help pile the bottles, the outer face of the cover (12) fits against the sides (16) of the inferior concave face (14).

Some of the embodiments represented are symmetrical with respect to a vertical axis (9) of symmetry. However, this aspect is not relevant for the present invention, and multiple variants are possible.

The material used in the manufacturing of the bottles, the forms and dimensions of the same, and all details and accessories that may be included are independent of the subject matter of the invention, provided they do not affect the essence of the invention.

The invention claimed is:

1. A wine bottle, comprising a main body (2) and wine and a bottle neck inside of which a cap (4) is placed, where the bottle neck (3) is a unitary, integral part of the main body, forming a one piece glass bottle, and comprises a wall having an interior wall surface (5) in contact with the cap (4) and an exterior wall surface (6) not in contact with the cap (4), wherein at least part of the exterior wall surface (6) is located inside the bottle main body (2) and the bottle (1) is filled with the wine up to a fill level (7) above which there is an air chamber (8), and whereby with the bottle (1) in a vertical position, the fill level (7) of the wine reaches a point along the exterior wall surface (6) of the bottle neck (3) that is inside the bottle (1), and the wine is in contact with the cap (4) whether the bottle is in vertical position or in any other position.

2. The wine bottle, according to claim 1, wherein the bottle (1) is symmetric with regard to a vertical axis (9).

3. The wine bottle, according to claim 1, wherein the bottle neck (3) is completely surrounded by an exterior bottle neck (10), leaving the air chamber (8) and the fill level (7) located between both bottle necks (3, 10).

4. The wine bottle, according to claim 1, wherein the bottle (1) is symmetric with regard to a vertical axis (9), and the bottle neck (3) is completely surrounded by an exterior bottle neck (10), leaving the air chamber (8) and the fill level (7) located between both bottle necks (3, 10).

5. The wine bottle, according to claim 1, wherein the bottle neck (3) is partially surrounded by an exterior bottle neck (10), leaving the air chamber (8) and the fill level (7) located between the exterior bottle neck (10) and the exterior wall surface (6) of the bottle neck (3) which are covered by the exterior bottle neck (10).

6. The wine bottle, according to claim 1, wherein the bottle neck (3) is located on a superior concave face (11) of the main body (2), wherein on said superior concave face (11) there is a cover (12) that partially covers the superior concave face (11), there being formed a wine drop accumulation area (13) between the cover (12) and the superior concave face (11).

7. The wine bottle, according to claim 6, wherein the cover (12) is continuous along the complete perimeter of the superior concave face (11).

8. The wine bottle, according to claim 6, wherein the main body (2) comprises an inferior concave face (14) forming a housing area (15), capable of housing the bottle neck (1) and the cover (12) of a second bottle which were piled underneath the bottle (1).

9. The wine bottle, according to claim 8, wherein an outer face of the cover (12) fits against sides (16) of the inferior concave face (14).

10. The wine bottle, according to claim 1, wherein the cap is a cork.

11. The wine bottle, according to claim 1, wherein the cap has a longitudinal length that is equal to a longitudinal length of the bottle neck.

* * * * *